US010367335B2

(12) United States Patent
Kawashima et al.

(10) Patent No.: US 10,367,335 B2
(45) Date of Patent: Jul. 30, 2019

(54) SPARK PLUG AND PRODUCTION METHOD THEREFOR

(71) Applicant: NGK SPARK PLUG CO., LTD., Nagoya-shi, Aichi (JP)

(72) Inventors: Yusuke Kawashima, Kakamigahara (JP); Hiroyuki Hazama, Nagoya (JP)

(73) Assignee: NGK SPARK PLUG CO., LTD., Nagoya-shi, Aichi (JP)

( * ) Notice: Subject to any disclaimer, the term of this patent is extended or adjusted under 35 U.S.C. 154(b) by 0 days.

(21) Appl. No.: 16/091,144

(22) PCT Filed: Jan. 13, 2017

(86) PCT No.: PCT/JP2017/001052
§ 371 (c)(1),
(2) Date: Oct. 4, 2018

(87) PCT Pub. No.: WO2017/203742
PCT Pub. Date: Nov. 30, 2017

(65) Prior Publication Data

US 2019/0131775 A1 May 2, 2019

(30) Foreign Application Priority Data

May 24, 2016 (JP) ..... 2016-103310

(51) Int. Cl.
*H01T 13/32* (2006.01)
*H01T 21/02* (2006.01)
*H01T 13/39* (2006.01)

(52) U.S. Cl.
CPC ..... *H01T 13/32* (2013.01); *H01T 21/02* (2013.01); *H01T 13/39* (2013.01)

(58) Field of Classification Search
CPC ..... H01T 13/32; H01T 21/02; H01T 3/39
See application file for complete search history.

(56) References Cited

U.S. PATENT DOCUMENTS 6,337,533 B1 1/2002 Hanashi et al.
10,122,154 B1 * 11/2018 Yamamoto ..... H01T 13/20
(Continued)

FOREIGN PATENT DOCUMENTS

DE 10103046 A1 7/2002
JP S52-149353 A 6/1976
(Continued)

*Primary Examiner* — Anne M Hines
(74) *Attorney, Agent, or Firm* — Kusner & Jaffe

(57) ABSTRACT

Disclosed is a spark plug having a ground electrode in which a weld zone is formed a tip and electrode base. The weld zone has: a back region exposed at an opposite surface of the electrode base; a joint region at which the tip is joined; and a connection region connects the joint region and the back region without being exposed at side surfaces of the electrode base. In a cross section of the ground electrode taken through the side surfaces of the electrode base along a plane passing through the centers of the top and bottom surfaces of the tip, a value of a width of the top surface of the tip being divided by a width of the facing surface of the electrode base is greater than 0.3, and a maximum width of the connection region is larger than a width of the back region.

7 Claims, 8 Drawing Sheets

(56) References Cited

U.S. PATENT DOCUMENTS

| | | | | |
|---|---|---|---|---|
| 2014/0152170 | A1* | 6/2014 | Kasuya | H01T 13/32 313/141 |
| 2014/0203701 | A1 | 7/2014 | Kretschmar et al. | |
| 2017/0214220 | A1* | 7/2017 | Inoue | H01T 13/32 |
| 2017/0288373 | A1* | 10/2017 | Araya | H01T 13/32 |

FOREIGN PATENT DOCUMENTS

| | | | |
|---|---|---|---|
| JP | S55-069913 | A | 10/1979 |
| JP | 2000-040577 | A | 2/2000 |
| JP | 2004-095214 | A | 3/2004 |
| JP | 2011-113978 | A | 6/2011 |
| JP | 2014-519169 | A | 8/2014 |

* cited by examiner

SPARK PLUG AND PRODUCTION METHOD THEREFOR

RELATED APPLICATIONS

This application is a National Stage of International Application No. PCT/JP17/01052 filed Jan. 13, 2017, which claims the benefit of Japanese Patent Application No. 2016-103310, filed May 24, 2016, the entire contents of which are incorporated herein by reference.

FIELD OF THE INVENTION

The present invention relates to a spark plug and a production method therefor. More particularly, the present invention relates to a spark plug having a ground electrode with improved spark wear resistance and a production method therefor.

BACKGROUND OF THE INVENTION

There is known a spark plug in which a tip containing a noble metal is joined to a center electrode-facing surface of an electrode base of a ground electrode so as to improve the spark wear resistance of the ground electrode. For example, Japanese Laid-Open Patent Publication No. 2000-40577 discloses a technique of joining a tip to an electrode base by forming a weld zone from a surface of the electrode base opposite a facing surface thereof toward a bottom surface of the tip. In recent years, there has been a tendency to increase the size of tips in association with the progress of high boosting and high gas flow in combustion chambers for improvements in internal combustion engine efficiency and fuel efficiency.

In the technique of Japanese Laid-Open Patent Publication No. 2000-40577, however, the weld zone increases in size to ensure the joint strength of the tip as the size of the tip becomes increased. With such increase in weld zone size, there arises a possibility that the weld zone may be exposed at a surface of the electrode base other than the opposite surface. When a part of the weld zone is exposed at a surface of the electrode base other than the opposite surface, the exposed part of the weld zone can serve as a starting point of spark wear. This makes it likely that wear of the ground electrode will proceed.

The present invention addresses the above problem. An advantage of the present invention is a spark plug that has a ground electrode with a tip joined thereto and combines the joint strength of the tip with the spark wear resistance of the ground electrode.

SUMMARY OF THE INVENTION

In accordance with a first aspect of the present invention, there is provided a spark plug comprising: a metal shell; a center electrode held insulatedly in the metal shell; and a ground electrode that includes an electrode base having a facing surface facing the center electrode and a tip containing a noble metal and arranged on the facing surface of the electrode base. The electrode base is joined at a first end portion thereof to the metal shell. The electrode base has: an opposite surface located opposite the facing surface; an end surface connecting the opposite surface and the facing surface at a second end portion of the electrode base opposite the first end portion; and a pair of side surfaces continuing to the end surface via sides of the second end portion and connecting the opposite surface and the facing surface. The tip has: a top surface facing the center electrode; and a bottom surface located opposite the top surface and joined to the electrode base with a weld zone formed therebetween.

The weld zone includes: a back region exposed at the opposite surface of the electrode base; a joint region at which the tip is joined; and a connection region connecting the joint region and the back region in a thickness direction of the electrode base without being exposed at the side surfaces of the electrode base. In a cross section of the ground electrode taken through the side surfaces of the electrode base along a plane passing through the centers of the top and bottom surfaces of the tip, a value of a width of the top surface of the tip being divided by a width of the facing surface of the electrode base is greater than 0.3 so that the top surface of the tip at which spark discharge is likely to occur is made relatively large in width. Further, a maximum width of the connection region in a direction perpendicular to the thickness direction of the electrode base is larger than a width of the back region. It is thus possible to ensure the joint area of the joint region and thereby attain the joint strength of the tip. As the exposed back region of the weld zone is present at the opposite surface of the electrode base at which spark discharge is unlikely to occur, it is possible to attain the spark wear resistance of the ground electrode. Accordingly, the spark plug combines both the joint strength of the tip and the spark wear resistance of the ground electrode.

In accordance with a second aspect of the present invention, there is provided a spark plug as described above, wherein, in the cross section, an interface of the joint region with the tip is convex toward the top surface. In this invention, the joint strength is attained at a center portion of the tip. The spark wear resistance of the tip is also attained by ensuring the distance from the bottom surface to the top surface at a peripheral portion of the tip. It is thus possible to combine the joint strength and spark wear resistance of the tip in addition to achieving the effects of the invention of claim 1.

In accordance with a third aspect of the present invention, there is provided a spark plug as described above, wherein, in the cross section, the bottom surface of the tip is located closer to the opposite surface than the facing surface of the electrode base, and the joint region is located closer to the opposite surface than the facing surface of the electrode base without being exposed at the facing surface of the electrode base. It is possible in this invention to prevent the joint region from serving as a starting point of spark wear, in addition to achieving the effects of the invention of claim 1 or 2.

In accordance with a fourth aspect of the present invention, there is provided a spark plug as described above, wherein the facing surface of the electrode base has base long sides bordering the side surfaces and a base short side bordering the end surface and being shorter than the base long sides, wherein the top surface of the tip has a long side and a short side, and wherein the tip is arranged on the facing surface, with the short side of the tip being along the base long side and the long side of the tip being along the base short side. When the spark plug is mounted to an internal combustion engine, a spark discharge is blown off due to the occurrence of gas flow in a combustion chamber of the internal combustion engine along a direction of the base short side of the facing surface of the electrode base. In this invention, however, the long side of the tip is aligned along such a direction so that the spark discharge can be prevented from occurring on the electrode base. It is thus possible to suppress spark wear of the electrode base in addition to achieving the effects of the invention of any of claims 1 to 3.

In accordance with a fifth aspect of the present invention, there is provided a spark plug as described above, wherein the weld zone is not exposed at the end surface of the electrode base. In this invention, the problem that the weld zone exposed at the end surface serves as a starting point of spark wear is avoided. It is thus possible to suppress spark wear of the end surface of the electrode base in addition to achieving the effects of the invention of any of claims 1 to 4.

In accordance with a sixth aspect of the present invention, there is provided a production method of a spark plug, the spark plug comprising: a metal shell; a center electrode held insulatedly in the metal shell; and a ground electrode that includes an electrode base having a facing surface facing the center electrode and a tip containing a noble metal and arranged on the facing surface of the electrode base, the electrode base being joined at a first end portion thereof to the metal shell.

The production method comprises: a contact step of bringing a bottom surface of the tip opposite to a top surface thereof into contact with the electrode base, the electrode base having: an opposite surface located opposite the facing surface; an end surface connecting the opposite surface and the facing surface at a second end portion of the electrode base opposite the first end portion; and a pair of side surfaces continuing to the end surface via sides of the second end portion and connecting the facing surface and the opposite surface; and an irradiation step of forming a weld zone by emitting a laser light toward the tip from the opposite surface while moving an beam axis of the laser light in a reciprocating manner relative to the electrode base in a direction in which the side surfaces of the electrode base are opposed to each other. In this invention, loci of the beam axis intersect at a position facing the opposite surface of the electrode base so that a width of the weld zone in the direction in which the side surfaces of the electrode base are opposed to each other is made smaller in the vicinity of the opposite surface than in the vicinity of the facing surface. It is thus possible to easily produce the spark plug as in the invention of claim 1.

In accordance with a seventh aspect of the present invention, there is provided a production method of a spark plug as described above, wherein, in the irradiation step, a focal point of the laser light at positions closer to the side surfaces of the electrode base than a position corresponding a center of the bottom surface of the tip is closer to the opposite surface of the electrode base than that at the position corresponding to the center of the bottom surface of the tip. In this invention, the peripheral portion of the tip is made less likely to be fused than the center portion of the tip. It is thus possible to stably produce the spark plug, while ensuring the spark wear resistance of the tip, in addition to achieving the effects of the invention of claim 6.

BRIEF DESCRIPTION OF DRAWINGS

FIG. 5(*b*) is a cross-sectional view of the ground electrode as taken along line Vb-Vb of FIG. 5(*a*).

FIG. 6(*b*) is a cross-sectional view of the ground electrode as taken along line VIb-VIb of FIG. 6(*a*).

FIG. 7(*b*) is a cross-sectional view of the ground electrode as taken along line of FIG. 7(*a*).

FIG. 8(*b*) is a cross-sectional view of the ground electrode as taken along line VIIIb-VIIIb of FIG. 8(*a*).

DETAILED DESCRIPTION OF THE INVENTION

Hereinafter, preferred embodiments of the present invention will be described blow with reference to the drawings.

Figure 1:
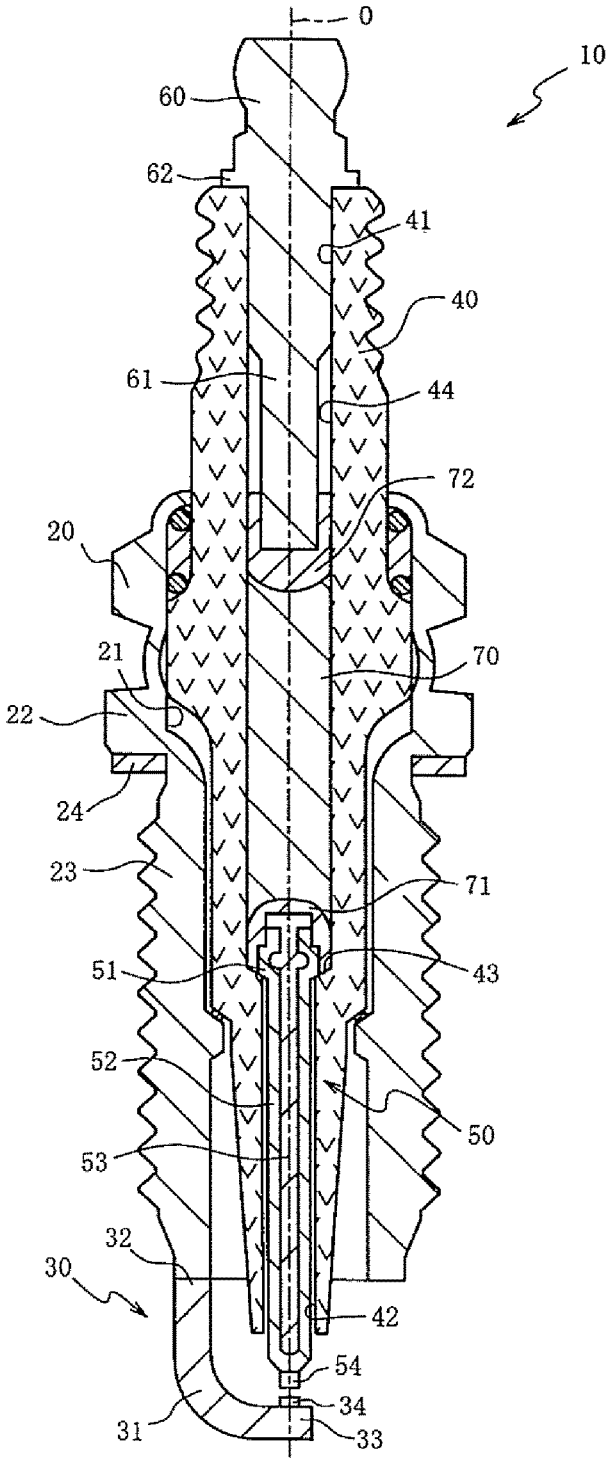
FIG. 1 is a cross-sectional view of a spark plug according to a first embodiment of the present invention.

FIG. 1 is a cross-sectional view of a spark plug 10, taken along a plane including a center axis O of the spark plug, according to a first embodiment of the present invention. Herein, the lower and upper sides in FIG. 1 are referred to as front and rear sides of the spark plug 10, respectively. As shown in FIG. 1, the spark plug 10 is provided with a metal shell 20, a ground electrode 30, an insulator 40 and a center electrode 50.

The metal shell 20 is substantially cylindrical-shaped so as to be fixed in a screw hole (not shown) of an internal combustion engine. A through hole 21 is formed through the metal shell 20 along the center axis O. The metal shell 20 is made of a conductive metal material (e.g. low carbon steel), and includes: a seat portion 22 radially outwardly protruding in a collar shape; and a thread portion 23 formed on an outer circumferential surface of the metal shell 20 at a position frontward of the seat portion 22. An annular gasket 24 is fitted between the seat portion 22 and the thread portion 23. When the thread portion 23 is screwed into the screw hole of the internal combustion engine, the gasket 24 establishes a seal between the metal shell 20 and the internal combustion engine (engine head).

The ground electrode 30 has: an electrode base 31 made of a metal material (e.g. nickel-based alloy) and joined at a first end portion 32 thereof to a front end of the metal shell 20; and a tip 34 joined to a second end portion 33 of the electrode base 31 opposite the first end portion 32. The electrode base 31 is rod-shaped and bent toward the center axis O so as to intersect the center axis O. The tip 34 is made of a noble metal e.g. platinum, iridium, ruthenium, rhodium etc. or an alloy containing such a noble metal as a main component and is joined by laser welding to the electrode base 31 at a position intersecting the center axis O.

The insulator 40 is substantially cylindrical-shaped and made of e.g. alumina having good mechanical properties and high-temperature insulating properties. An axial hole 41 is formed through the insulator 40 along the center axis O. The insulator 40 is inserted in the through hole 21 of the metal shell 20 so that the metal shell 20 is fixed on an outer circumference of the insulator 40. Front and rear ends of the insulator 40 are respectively exposed from the through hole 21 of the metal shell 20.

The axial hole 41 includes: a first hole region 42 located in a front end part of the insulator 40; a step region 43 continuing to a rear end of the first hole region 42 and having a diameter increasing toward the rear; and a second hole region 44 located rearward of the step region 43. An inner diameter of the second hole region 44 is set larger than an inner diameter of the first hole region 42.

The center electrode 50 is rod-shaped, having: a bottomed cylindrical-shaped electrode base; and a core 53 being higher in thermal conductivity than the electrode base and embedded in the electrode base. The core 53 is made of copper or an alloy containing copper as a main component. The center electrode 50 includes: a head portion 51 arranged on the step region 43 of the axial hole 41; and a leg portion 52 extending toward the first hole region 42 along the center axis O.

A front end of the leg portion 52 is exposed from the first hole region 42. A tip 54 is joined by laser welding to the exposed front end of the leg portion 52. The tip 54 is made of a noble metal e.g. platinum, iridium, ruthenium, rhodium etc. or an alloy containing such a noble metal as a main component in a cylindrical column shape. The tip 54 is opposed to and faces the tip 34 of the ground electrode 30 via a spark gap.

A metal terminal 60 is made of a conductive metal material (e.g. low carbon steel) in a rod shape for connection to a high voltage cable (not shown). A front end part of the metal terminal 60 is disposed in the axial hole 41 of the insulator 40.

A resistor 70 is disposed between the metal terminal 60 and the center electrode 50 within the second hole region 44 so as to suppress radio noise caused by spark discharge. Further, conductive glass seals 71 and 72 are respectively disposed between the resistor 70 and the center electrode 50 and between the resistor 70 and the metal terminal 60. The glass seal 71 is in contact with the resistor 70 and the center electrode 50, whereas the glass seal 72 is in contact with the resistor 70 and the metal terminal 60. As a consequence, the center electrode 50 and the metal terminal 60 are electrically connected to each other via the resistor 70 and the glass seals 71 and 72.

The above-structured spark plug 10 can be produced by, for example, the following method. First, the center electrode 50 is inserted through the second hole region 44 of the insulator 40. The tip 54 has been welded to the front end of the leg portion 52 of the center electrode 50. Then, the center electrode 50 is arranged such that the head portion 51 is supported on the step region 43 and such that the front end portion of the center electrode 50 is exposed outside from the front end of the axial hole 41.

A raw material powder of the glass seal 71 is charged through the second hole region 44 and filled into a space around and rearward of the head portion 51. The raw material powder of the glass seal 71 filled in the second hole region 44 is pre-compressed using a compression rod member (not shown). Into a space on the thus-compressed raw material powder of the glass seal 71, a raw material powder of the resistor 70 is filled. The raw material powder of the resistor 70 filled in the second hole region 44 is pre-compressed using a compression rod member (not shown). Into a space on the thus-compressed raw material powder of the resistor 70, a raw material powder of the glass seal 72 is filled. The raw material powder of the glass seal 72 filled in the second hole region 44 is pre-compressed using a compression rod member (not shown).

After that, the front end part 61 of the metal terminal 60 is inserted into the axial hole 41 from the rear end side. The metal terminal 60 is arranged such that the front end part 61 is brought into contact with the raw material powder of the glass seal 72. While heating to a temperature higher than the softening points of glass components contained in the respective raw material powders, the metal terminal 60 is press-fitted until contact of a front end surface of a bulged portion 62 formed on a rear end part of the metal terminal 60 with a rear end surface of the insulator 40, so as to apply a load to the raw material powders of the glass seal 71, the resistor 70 and the glass seal 71 by the front end part 61. As a result, the respective raw material powders are compressed and sintered, thereby forming the glass seal 71, the resistor 70 and the glass seal 72 within the insulator 40.

Subsequently, the metal shell 20 to which the ground electrode 30 has been joined is fitted onto the outer circumference of the insulator 40. Then, the tip 34 is welded to the electrode base 31 of the ground electrode 30; and the electrode base 31 is bent such that tip 34 of the ground electrode 30 is opposed to and faces the tip 54 of the center electrode 50 in the direction of the center axis. With this, the spark plug 10 is obtained.

Figure 2A:
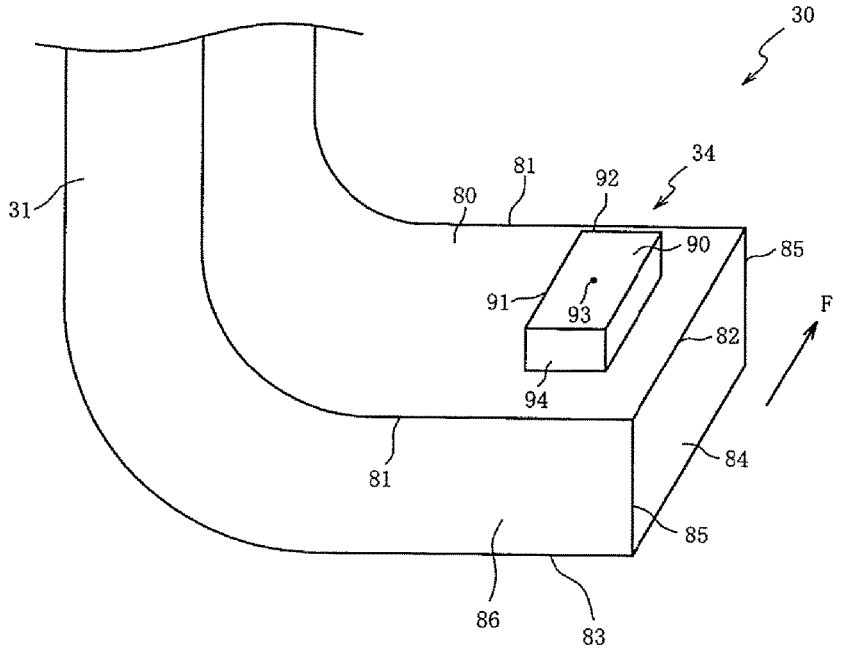
FIGS. 2(*a*) and 2(*b*) are a perspective view and a plan view of a ground electrode of the spark plug.
Figure 2B:
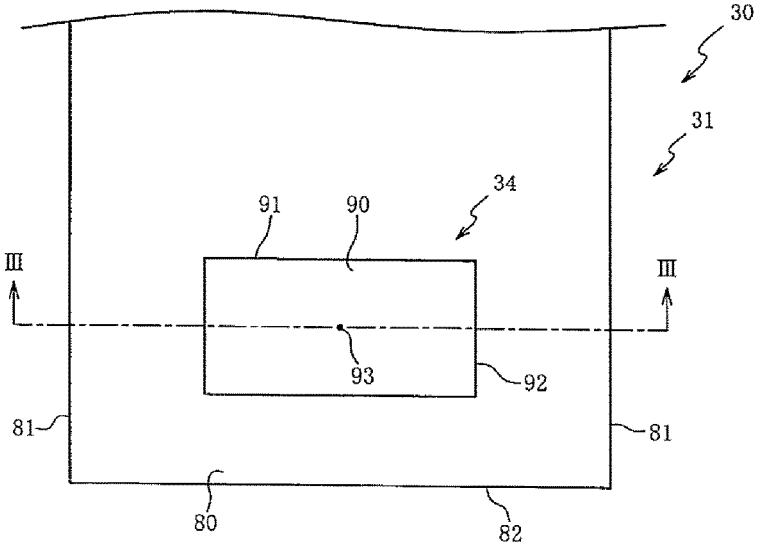

The ground electrode 30 will be now explained in more detail below with reference to FIG. 2. FIG. 2(*a*) is a perspective view of the ground electrode 30; and FIG. 2(*b*) is a plan view of the ground electrode 30. In FIG. 2(*a*), an arrow F indicates the direction of flow of an air-fuel mixture when the air-fuel mixture is taken into a combustion chamber of the internal combustion engine in a state that the spark plug 10 (see FIG. 1) is mounted to the internal combustion engine (not shown).

As shown in FIG. 2(*a*), the ground electrode 30 is provided with the electrode base 31 and the tip 34. The tip 34 is joined to a facing surface 80 of the second end portion 33 (see FIG. 1) of the electrode base 31 facing the center electrode 50 (see FIG. 1). The second end portion 33 of the electrode base 31 has a substantially rectangular parallelepiped shape surrounded by: the facing surface 80 to which the tip 34 is joined; an opposite surface 83 located opposite the facing surface 80; an end surface 84 connecting the facing surface 80 and the opposite surface 83 via a base short side 82; and side surfaces 86 continuing to the end surface 84 via sides 85.

The side surfaces 86 connects the facing surface 80 and the opposite surface 83 via base long sides 81. The base long sides 81 are set larger in dimension than the base short side 82. The first end portion 32 of the electrode base 31 is located on an extension of the base long sides 81.

The tip 34 is made of a noble metal tip or an alloy containing a noble metal as a main component in a rectangular parallelepiped shape. The tip 34 has: a rectangular top surface 90 facing the center electrode 50 (see FIG. 1); a rectangular bottom surface 95 (see FIG. 3) located opposite the top surface 90; and a side surface 94 connecting the top surface 90 and the bottom surface 95. As shown in FIG. 2(*b*), the top surface 90 of the tip 34 is surrounded by two long sides 91 and two short sides 92 shorter than the long sides 91.

The tip 34 is arranged on the facing surface 80 of the electrode base 31, with the long sides 91 of the tip 34 being along the base short side 82 of the electrode base 31 and the short sides 92 of the tip 34 being along the base long sides 81 of the electrode base 31. When the spark plug 10 (see FIG. 1) is mounted to the internal combustion engine (not shown) in such a manner that the base short side 82 of the electrode base 31 and the long sides 91 of the tip 34 are aligned along the direction of gas flow in the combustion chamber of the internal combustion engine (that is, the direction of the allow F), it is possible to prevent the electrode base 31 from interfering with gas flow in the combustion chamber and suppress spark wear of the electrode base 31 caused by spark discharge between the tip 34 and the center electrode 50 being blown by the gas flow.

Figure 3:
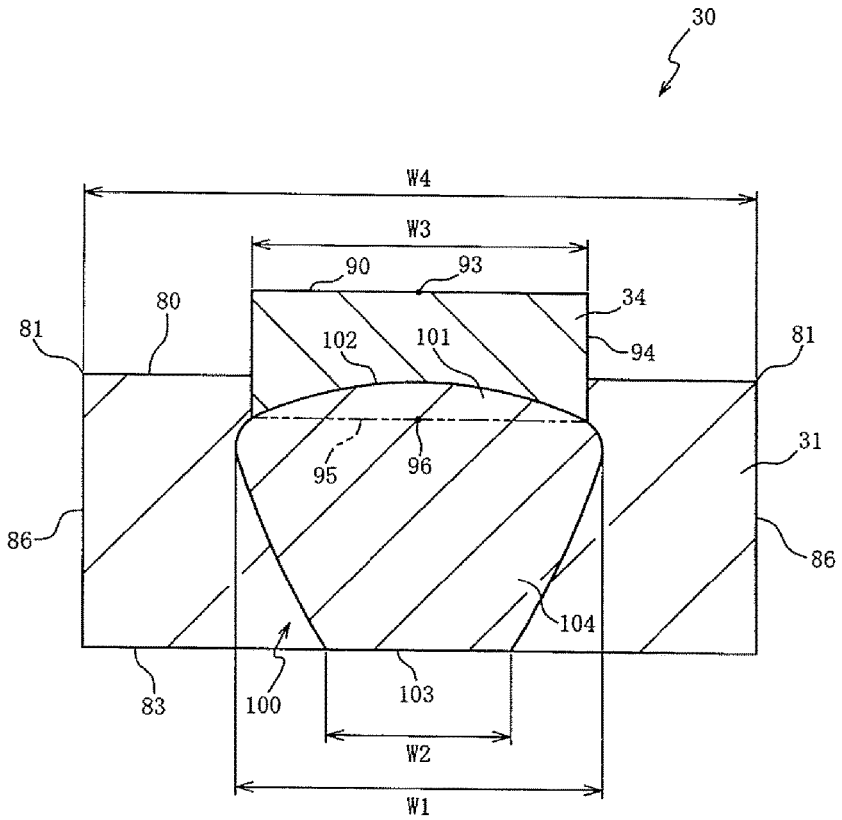
FIG. 3 is a cross-sectional view of the ground electrode as taken along line of FIG. 2.

Next, a joint structure of the tip 34 will be explained below with reference to FIG. 3. FIG. 3 is a cross-sectional view of the ground electrode 30 taken along line of FIG. 2. The cross-sectional view of FIG. 3 shows a cross section of the ground electrode as taken through the side surfaces 86 of the electrode base 31 along a plane passing through the center 93 of the top surface 90 and the center 96 of the bottom surface 95 of the tip 34 (i.e. a plane parallel to the base short side 82).

In a state that the tip 34 is joined to the electrode base 31, the bottom surface 95 of the tip 34 is fused in a weld zone 100. In FIG. 3, the bottom surface 95 of the tip 34 present before fusing is indicated by an imaginary line. Further, the first end portion 32 of the electrode base 31 is omitted from illustration for simplification purposes. As to the omission of the first end portion 32 and the indication of the bottom surface 95, the same applies to FIGS. 5(*b*), 6(*b*), 7(*b*) and 8(*b*) mentioned later.

As shown in FIG. 3, a bottom surface 95 side part of the side surface 94 is embedded in the electrode base 31. Consequently, the bottom surface 95 of the tip 34 is located closer to the opposite surface 83 than the facing surface 80 of the electrode base 31. The weld zone 100 for joining of the tip 34 and the electrode base 31 includes: a joint region 101 at which the tip 34 is joined by fusion; a back region 103 exposed at the opposite surface 83 of the electrode base 31; and a connection region 104 connecting the back region 103 and the joint region 101 in a thickness direction of the electrode base 31 (i.e. in a vertical direction in FIG. 3).

The joint region 101 is a region of the weld zone at which the tip 34 is joined by being fused to the electrode base 31. An interface 102 of the joint region 101 with the tip 34 is convex toward the top surface 90 of the tip 34. The joint region 101 is not exposed at the facing surface 80 of the electrode base 31 and is located closer to the opposite surface 83 of the electrode base 31 than the facing surface 80. On the other hand, the back region 103 is a region of the weld zone 100 which is exposed at the opposite surface 83 of the electrode base 31.

The connection region 104 is a region of the weld zone which connects the back region 103 and the joint region 101 without being exposed to the side surfaces 86 of the electrode base 31. In the present embodiment, the connection region 104 is not also exposed at the end surface 84 (see FIG. 2(*a*)) of the electrode base 31. The connection region 104 has a shape that gradually increases in width (i.e. horizontal dimension in FIG. 3) from the back region 103 toward the joint region 101. Namely, a maximum width W1 of the connection region 104 in a direction perpendicular to the thickness direction of the electrode base 31 (i.e. in a horizontal direction in FIG. 3) is set larger than a width W2 of the back region 103.

A part of the connection region 104 at which the maximum width W1 occurs is located closer to the opposite surface 83 of the electrode base 31 than the bottom surface 95 of the tip 34. The maximum width W1 of the connection region 104 is also set larger than a width W3 of the top surface 90 of the tip 34. Furthermore, a value (W3/W4) of the width W3 of the top surface 90 of the tip 34 being divided by a width W4 of the facing surface 80 of the electrode base 31 is set greater than 0.3.

As mentioned above, the value of the width W3 of the top surface 90 of the tip 34 being divided by the width W4 of the facing surface 80 of the electrode base 31 is set greater than 0.3 (W3/W4>0.3) so that the width W3 of the top surface 90 of the tip 34 is made relatively large. Hence, spark discharge is likely to occur at the top surface 90 of the tip 34 but is unlikely to occur at the electrode base 31. The exposed back region 103 of the weld zone 100 is present at the opposite surface 83 of the electrode base 31 at which spark discharge is less likely to occur. It is thus possible to attain the spark wear resistance of the ground electrode 30. Further, the maximum width W1 of the connection region 104 in the direction perpendicular to the thickness direction of the electrode base 31 is set larger than the width W2 of the back region 103. It is thus possible to ensure the joint area of the weld zone 100 and thereby attain the joint strength of the tip 34. Accordingly, the spark plug combines the joint strength of the tip 34 with the spark wear resistance of the ground electrode 30.

In the present embodiment, the interface 102 of the joint region 101 with the tip 34 is convex toward the top surface 30 of the tip 34. In this configuration, the joint strength of the tip 34 is attained by ensuring the volume of the joint region 101 in the vicinity of the center 93, 96 of the tip 34. As the joint region 101 is not formed on the side surface 94 of the tip 34, the spark wear resistance of the tip 34 is also attained by ensuring the distance from the bottom surface 95 to the top surface 90 at a peripheral portion of the tip 34. It is thus possible to attain the joint strength and spark wear resistance of the tip 34.

Further, the part of the connection region 104 at which the maximum width W1 occurs is located closer to the opposite surface 83 of the electrode base 31 than the bottom surface 95 of the tip 34. The maximum width W1 of the connection region 104 is set larger than the width W3 of the top surface 90 of the tip 34. The joint area between the connection region 104 and the electrode base 31 is ensured and, at the same time, the joint area between the joint region 101 and the tip 34 is ensured. It is thus possible to attain the joint strength of the tip 34 to the electrode base 31.

The bottom surface 95 of the tip 34 is located closer to the opposite surface 83 than the facing surface 80 of the electrode base 31; and the joint region 101 is not exposed at the facing surface 80 of the electrode base 31 and is located closer to the opposite surface 83 than the facing surface 80 of the electrode base 31. Namely, the joint region 101 is embedded in the electrode base 31 and hence is unlikely to serve as a starting point of spark wear. It is thus possible to suppress spark wear of the electrode base 31.

As the weld zone 100 is not exposed at the end surface 84 (see FIG. 2(*a*)) of the electrode base 31, the problem that the weld zone 100 exposed at the end surface 84 serves as a starting point of spark wear is avoided. It is thus possible to suppress spark wear of the end surface 84 of the electrode base 31.

Figure 4:
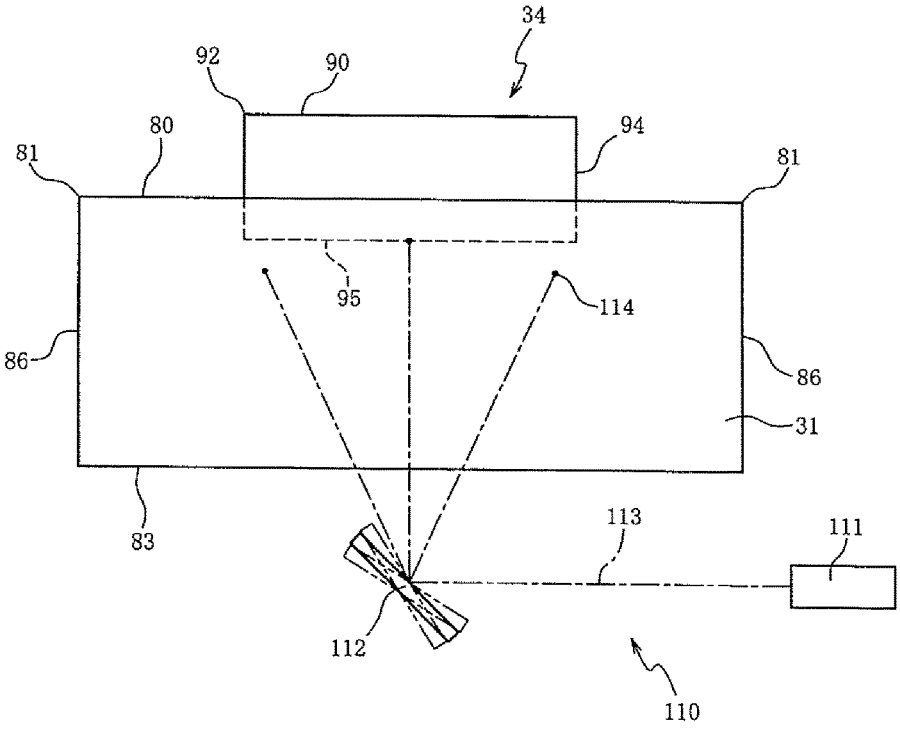
FIG. 4 is a schematic view of a welding machine.

A method for joining the electrode base 31 and the tip 34 will be next explained below with reference to FIG. 4. FIG. 4 is a schematic view of a welding machine 110. The welding machine 110 includes: an irradiation head 111 that emits a laser light; and a mirror 112 that reflects the laser light emitted from the irradiation head 111 so as to irradiate the electrode base 31 with the reflected laser light. For ease of understanding, a beam axis 113 of the laser light (i.e. a straight line connecting the spatial centers of cross sections of the laser light) is shown in FIG. 4.

The mirror 112 is situated at a position facing the opposite surface 83 of the electrode base 31 and is swingable about an axis (not shown) perpendicular to the beam axis 113. The laser light is scanned by changing the reflection angle of the mirror. The irradiation head 111 does not change its focal length (that is, maintains the length of the beam axis 113 constant) during scanning of the laser light by swinging of the mirror 112, whereby a focal point 114 of the laser light in the vicinity of the center of the tip 34 is closer to the opposite surface 83 than that in the vicinity of the periphery of the tip 34.

To join the tip 34 to the electrode base 31, the tip 34 is first placed on and temporarily fixed to the facing surface 80 of the electrode base 31. The temporary fixing can be done by resistance welding the tip 34 with the application of pressure to press the bottom surface 95 of the tip 34 against the facing surface 80 and thereby embedding the bottom surface 95 side part of the tip 34 into the electrode base 31. Alternatively, the temporary fixing can be done by forming a depression in the facing surface 80 and fitting the tip 34 in the depression.

The laser light is then emitted from the irradiation head 111 toward the mirror 112. Then, the electrode base 31 is irradiated with the laser light from the opposite surface 83 side by swinging the mirror 112 and scanning the beam axis 113 in a reciprocating manner in a direction in which the side surfaces 86 of the electrode base 31 are opposed to each other (i.e. in a horizontal direction in FIG. 4). The scanning loci of the beam axis 113 intersect at the surface of the mirror 112. In the present embodiment, the focal point 114 of the laser light is set on the bottom surface 95 of the tip 34 at the center of the tip 34 and is set in the electrode base 31 in the vicinity of the periphery of the tip 34. By such laser irradiation, the weld zone 100 (see FIG. 3) is formed in the direction of the long side 91 of the tip 34 (see FIG. 2(*b*)) whereby the tip 34 is joined to the electrode base 31.

In the above production method of the ground electrode 30, the laser light is irradiated such that the loci of the beam axis 113 intersect at the surface of the mirror 112 situated facing the opposite surface 83 of the electrode base 31. Hence, the width of the weld zone 100 in the direction in which the side surfaces 86 of the electrode base 31 are opposed to each other is made smaller in the vicinity of the opposite surface 83 of the electrode base 31 than in the vicinity of the facing surface 80 of the electrode base 31. It is thus possible to easily form the weld zone 100 in which the maximum width W1 of the connection region 104 is larger than the width W2 of the back region 103.

Further, the irradiation head 111 is set such that the focal point 114 of the laser light at positions closer to the side surfaces 86 of the electrode base 31 than a position corresponding the center of the bottom surface 95 of the tip 34 is closer to the opposite surface 83 of the electrode base 31 than that at the position corresponding to the center of the tip 34. By this setting, the peripheral portion of the tip 34 is made less likely to be fused than the center portion of the tip 34 so that the distance between the top surface 90 and the bottom surface 95 at the peripheral portion of the tip 34 is ensured. It is thus possible to stably produce the spark plug 10 that attains the spark wear resistance of the tip 34.

As the laser light, either a continuous-wave laser light or a pulsed layer light can be used. In the case where the length of the short side 92 of the tip 34 is large, the welding machine 110 is moved along the base long side 81 of the electrode base 31 (i.e. in a direction vertical to the paper surface of FIG. 4) while maintaining the positional relationship of the focal point 114 and the tip 34. It is possible by such operation to stably form the weld zone 100 in the direction of the short side 92 of the tip 34 as well.

Next, a second embodiment of the present invention will be explained below with reference to FIG. 5. The first embodiment refers to the case where the bottom surface 95 of the tip 34 is embedded in the facing surface 80 of the electrode base 31. By contrast, the second embodiment refers to the case where a bottom surface 125 of a tip 121 is flush with the facing surface 80 of the electrode base 31. In the second embodiment, like parts and portions to those of the first embodiment are designated by like reference numerals to omit detailed explanations thereof.

Figure 5A:
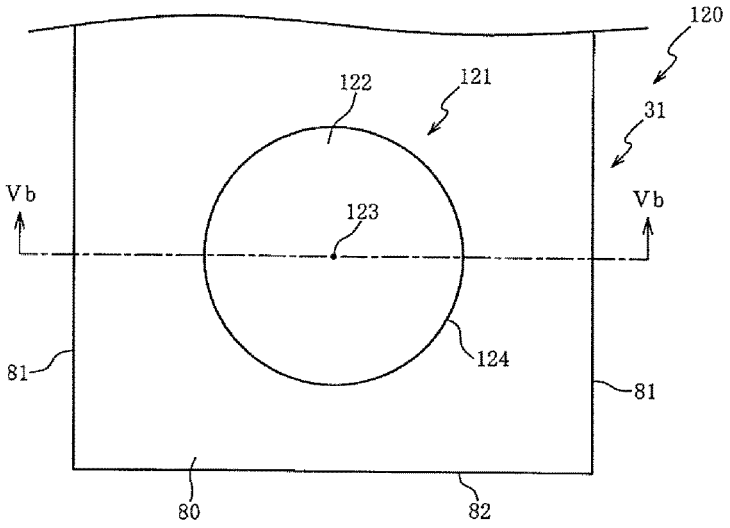
FIG. 5(*a*) is a plan view of a ground electrode according to a second embodiment of the present invention.
Figure 5B:
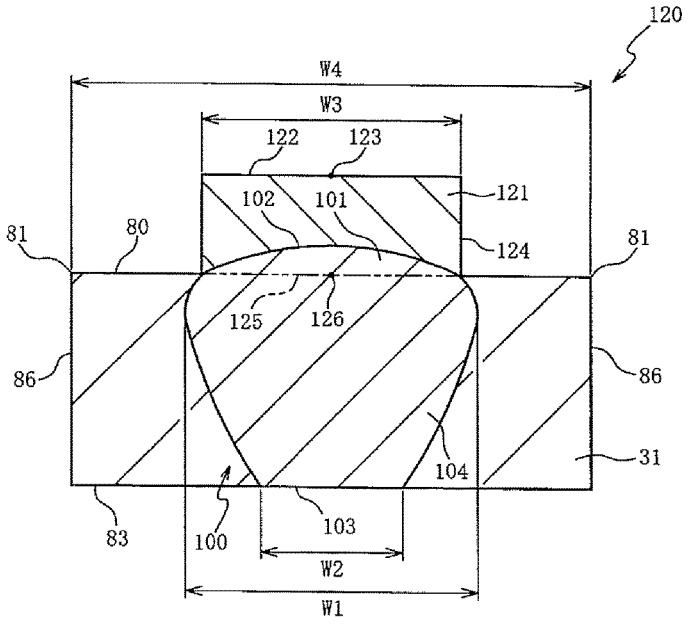

FIG. 5(*a*) is a plan view of a ground electrode 120 according to the second embodiment; and FIG. 5(*b*) is a cross-sectional view of the ground electrode 120 taken along line Vb-Vb of FIG. 5(*b*). The cross-sectional view of FIG. 5(*b*) shows a cross section of the ground electrode as taken through the side surfaces 86 of the electrode base 31 along a plane passing through the center 123 of a top surface 122 and the center 126 of the bottom surface 125 of the tip 121 (i.e. a plane parallel to the base short side 82).

As shown in FIGS. 5(*a*) and 5(*b*), the tip 121 is arranged on the facing surface 80 of the electrode base 31 of the ground electrode 120. The tip 121 has a disk shape surrounded by: the top surface 122 circular in shape; the bottom surface 125 circular in shape and located opposite the top surface 122; and a cylindrical side surface 124.

The tip 121 is joined by the weld zone 100 to the electrode base 31 with the bottom surface 125 being in flush with the facing surface 80. The joint region 101 of the weld zone at which the tip 121 is joined is not exposed at the side surface 124 of the tip 121. Further, the interface 102 of the joint region 101 with the tip 121 is convex toward the top surface 122 of the tip 121. It is accordingly possible in the second embodiment to obtain the same effects as those in the first embodiment.

A third embodiment of the present invention will be explained below with reference to FIG. 6. The third embodiment refers to the case where a ground electrode 130 has a square column-shaped tip 131 joined to the electrode base 31. In the third embodiment, like parts and portions to those of the first embodiment are designated by like reference numerals to omit detailed explanations thereof.

Figure 6A:
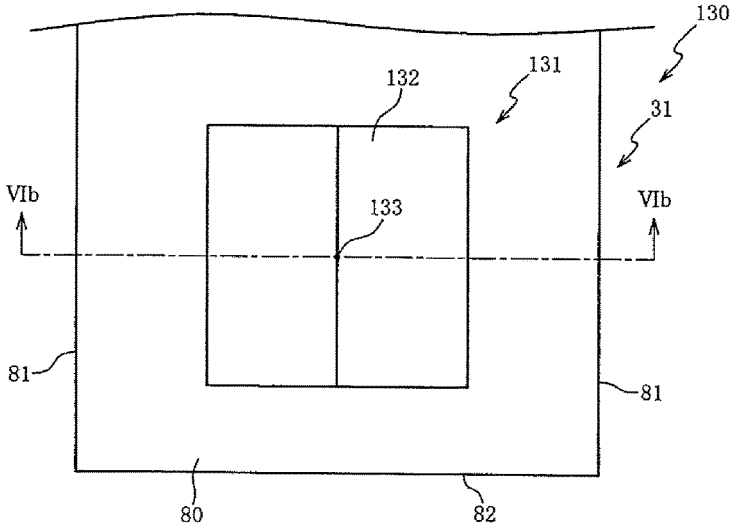
FIG. 6(*a*) is a plan view of a ground electrode according to a third embodiment of the present invention.
Figure 6B:
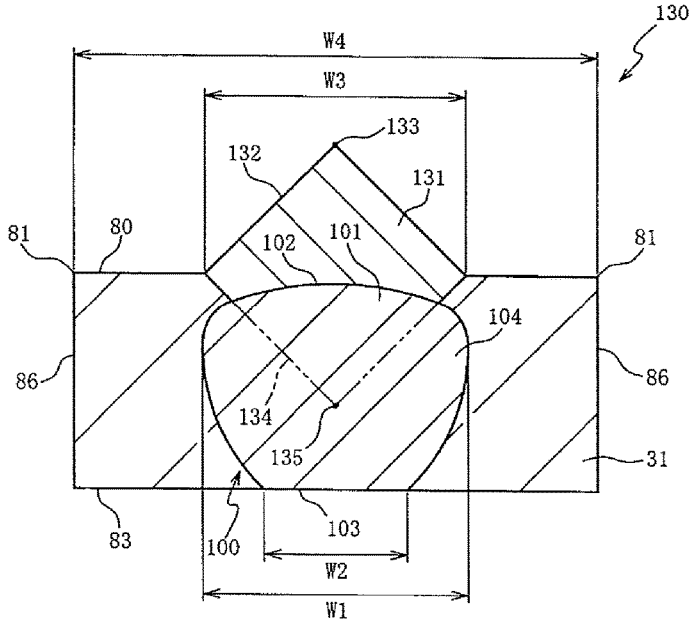

FIG. 6(*a*) is a plan view of the ground electrode 130 according to the third embodiment; and FIG. 6(*b*) is a cross-sectional view of the ground electrode 130 taken along line VIb-VIb of FIG. 6(*b*). The cross-sectional view of FIG. 6(*b*) shows a cross section of the ground electrode 130 as taken through the side surfaces 86 of the electrode base 31 along a plane passing through the center 133 of a top surface 132 and the center 135 of a bottom surface 134 of the tip 131 (i.e. a plane parallel to the base short side 82).

As shown in FIGS. 6(*a*) and 6(*b*), the tip 131 is arranged on the facing surface 80 of the electrode base 31 of the ground electrode 130. The tip 131 has a square column shape with four lateral sides, two of which form a top surface 132 and the other two of which form a bottom surface 134. The whole of the bottom surface 134 of the tip 131 is embedded in the weld zone 100. The joint region 101 is formed on a part of the bottom surface 134 without the weld zone 100 being exposed to the facing surface 80 of the electrode base 31. As the weld zone 100 is not exposed at the facing surface 80, it is possible to prevent the weld zone 100 from serving as a starting point of spark wear of the electrode base 31.

A fourth embodiment of the present invention will be explained below with reference to FIG. 7. The third embodiment refers to the case where the square column-shaped tip 131 is joined to the electrode base 31 of the ground electrode 130. By contrast, the fourth embodiment refers to the case where a ground electrode 140 has a triangular column-shaped tip 141 joined to the electrode base 31. In the fourth embodiment, like parts and portions to those of the first embodiment are designated by like reference numerals to omit detailed explanations thereof.

Figure 7A:
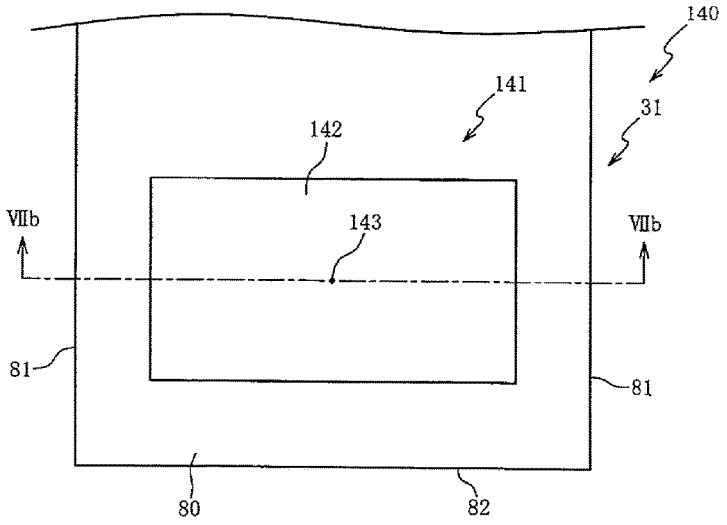
FIG. 7(*a*) is a plan view of a ground electrode according to a fourth embodiment of the present invention.
Figure 7B:
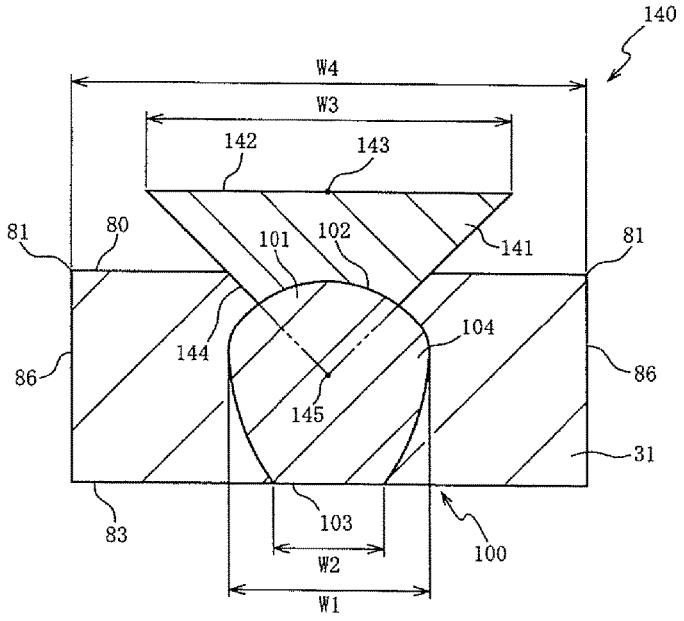

FIG. 7(*a*) is a plan view of the ground electrode 140 according to the fourth embodiment; and FIG. 7(*b*) is a cross-sectional view of the ground electrode 140 taken along line VIIb-VIIb of FIG. 7(*b*). The cross-sectional view of FIG. 7(*b*) shows a cross section of the ground electrode as taken through the side surfaces 86 of the electrode base 31 along a plane passing through the center 143 of a top surface 142 and the center 145 of a bottom surface 144 of the tip 141 (i.e. a plane parallel to the base short side 82).

As shown in FIGS. 7(*a*) and 7(*b*), the tip 141 is arranged on the facing surface 80 of the electrode base 31 of the ground electrode 140. The tip 141 has a triangular column shape with three lateral sides, one of which forms a top surface 142 and the other two of which form a bottom surface 144. A part of the bottom surface 144 of the tip 141 is embedded in the electrode base 31. The joint region 101 is formed on a part of the bottom surface 144 without the weld zone 100 being exposed to the facing surface 80 of the electrode base 31. It is thus possible to prevent the weld zone 100 from serving as a starting point of spark wear of the electrode base 31.

A fifth embodiment of the present invention will be explained below with reference to FIG. 8. The fourth embodiment refers to the case where the triangular column-shaped tip 141 is joined to the electrode base 31 of the ground electrode 140. By contrast, the fifth embodiment refers to the case where a ground electrode 150 has a circular column-shaped tip 151 joined the electrode base 31. In the fifth embodiment, like parts and portions to those of the first embodiment are designated by like reference numerals to omit detailed explanations thereof.

Figure 8A:
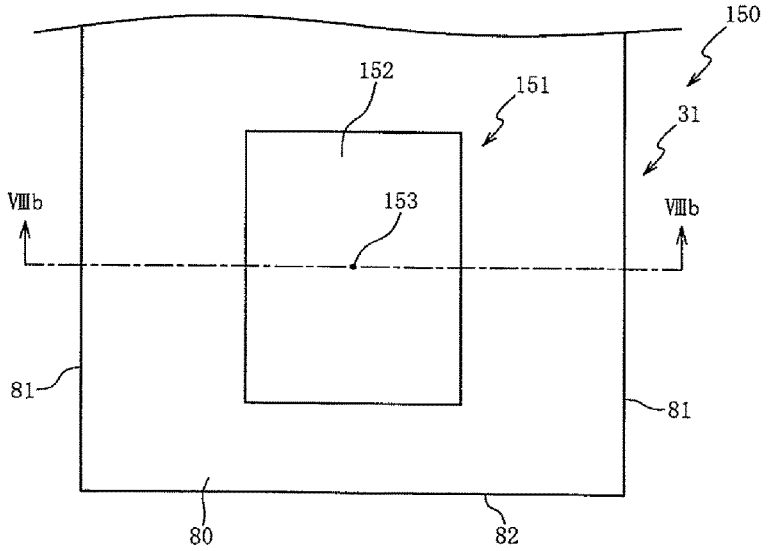
FIG. 8(*a*) is a plan view of a ground electrode according to a fifth embodiment of the present invention.
Figure 8B:
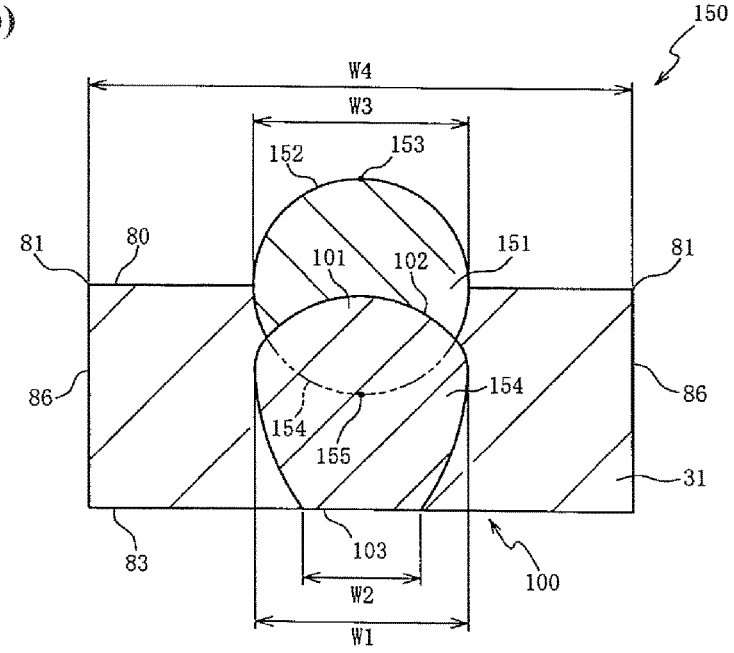

FIG. 8(*a*) is a plan view of the ground electrode 150 according to the fifth embodiment; and FIG. 8(*b*) is a cross-sectional view of the ground electrode 150 taken along line VIIIb-VIIIb of FIG. 8(*b*). The cross-sectional view of FIG. 8(*b*) shows a cross section of the ground electrode as taken through the side surfaces 86 of the electrode base 31 along a plane passing through the center 153 of a top surface 152 and the center 155 of a bottom surface 154 of the tip 151 (i.e. a plane parallel to the base short side 82).

As shown in FIGS. 8(*a*) and 8(*b*), the tip 151 is arranged on the facing surface 80 of the electrode base 31 of the ground electrode 150. The tip 151 has a cylindrical column shape with a cylindrical peripheral surface, a half of which forms a top surface 152 and the other half of which forms a bottom surface 154. The whole of the bottom surface 154 is embedded in the electrode base 31. The joint region 101 is formed on a part of the bottom surface 154 without the weld zone 100 being exposed at the facing surface 80 of the electrode base 31. It is thus possible to prevent the weld zone 100 from serving as a starting point of spark wear of the electrode base 31.

EXAMPLES

The present invention will be described in more detail below by way of the following examples. It should be noted that the following explanations are illustrative and are not intended to limit the present invention thereto.

Example

Various types of ground electrodes 30 were obtained by providing electrode bases 31 as explained above in the first embodiment and joining various tips 34 to the respective electrode bases 31. The length of the long sides 91 of the tip 34 was different from one type to another, thereby setting different values (W3/W4) of the width W3 of the top surface 90 of the tip 34 divided by the width W4 of the facing surface 80 of the electrode base 31. In each ground electrode, the tip 34 was laser welded to the electrode base 31 by emitting and scanning the laser light onto the opposite surface 83 of the electrode base 31 in such manner that loci of the beam axis 113 of the laser light intersected at a position facing the opposite surface 83 of the electrode base 31 as explained in the first embodiment. Herein, 30 samples (ground electrodes) for each value (W3/W4) were provided.

Comparative Example

In Comparative Example, ground electrodes were obtained in the same manner as in Example except for the method of laser welding the tip 34 to the electrode base 31. In Comparative Example, the irradiation head 111 was arranged to directly face the opposite surface 83 of the electrode base 31 so that the opposite surface 83 of the electrode base 31 was irradiated laser light emitted from the irradiation head 111 without using the mirror 112. The tip 34 was laser welded to the electrode base 31 by moving the irradiation head 111 along the opposite surface 31 of the electrode base 31 so as not to cause intersection of the loci of the beam axis 113 of the laser light and thereby scanning the laser light onto the opposite surface 83 of the electrode base 31.

<Evaluation>

The above-obtained samples (ground electrodes) were each evaluated by observing the appearance of the electrode base and checking whether or not the weld zone was exposed at the side surfaces of the electrode base. In the case where the weld zone was not exposed at the side surfaces of the electrode base in all of the 30 samples, the ground electrode was evaluated as "good (○)" was assigned. The ground electrode was evaluated as "inferior (○)" in the case where the weld zone was exposed at the side surfaces of the electrode base in some of the 30 samples. In the case where the weld zone was exposed at the side surfaces of the electrode base in all of the 30 samples, the ground electrode was evaluated as "significantly inferior (x)". The evaluation results are shown in TABLE 1.

TABLE 1

| W3/W4 | Example | Comparative Example |
|---|---|---|
| 0.2 | ○ | ○ |
| 0.3 | ○ | ○ |
| 0.4 | ○ | Δ |
| 0.5 | ○ | X |

As shown in TABLE 1, the evaluation results of Example were "good" in all of the samples where the value of W3/W4 ranged from 0.2 to 0.5. On the other hand, the evaluation results of Comparative Example were "inferior" or "significantly inferior" in the samples where the value of W3/W4 exceeded 0.3.

The weld zone is spread relative to the cross section of the laser light. When the tip is made relatively large to such an extent that the value of W3/W4 exceeds 0.3, the weld zone is exposed at the side surfaces of the electrode base by the scanning of the laser light onto the electrode base with parallel movement of the irradiation head as in Comparative Example.

As compared to Comparative Example, the area of the back region exposed at the opposite surface of the electrode base is made smaller by the scanning of the laser light onto the opposite surface of the electrode base with intersection of the beam axis of the laser light as in Example. By such laser irradiation, the weld zone is not exposed at the side surfaces of the electrode base. Even when the tip is made relatively large in size, the weld zone is prevented from being exposed at the side surface of the electrode base and serving as a starting point of spark wear so that the electrode base is less susceptible to spark wear. It is thus possible to make the tip relatively large and, at the same time, suppress spark wear of the electrode base.

Although the present invention has been described with reference to the above specific embodiments, the present invention is not limited to these specific embodiments. It is readily understood that various changes and modifications of the embodiments described above can be made within the range that does not depart from the scope and spirit of the invention.

For example, the above-mentioned shape and size of the electrode base 31 is merely one example and can be set as appropriate.

In the above respective embodiments, the tip 34, 121, 131, 141, 151 is arranged inside the facing surface 80 that is surrounded by the base long sides 81 and the base short side 82 of the electrode base 31. The present invention is however not necessarily limited to such a tip arrangement. It is alternatively feasible to arrange the tip on the facing surface 80 of the electrode base 31 with a part of the tip protruding toward the end surface 84 over the base short side 82. As another alternative, it is feasible to join the tip to the facing surface 80 with an end of the tip aligned on the base short side 82. In these cases, a part of the weld zone 100 may naturally be exposed at the end surface 84.

In the above first embodiment, the laser light is scanned over the electrode base 31 by swinging the mirror 112. The present invention is however not necessarily limited to such a scan configuration. It is alternatively feasible to scan the laser light over the electrode base 31 by allowing the irradiation head 111 to directly face the opposite surface 83 of the electrode base 31 without the use of the mirror 112 and swinging the irradiation head 111 itself. Even in this case, the loci of the beam axis of the laser light intersect at a position facing the opposite surface 83 of the electrode base 31.

In the above first embodiment, the scanning of the laser light is performed by moving the welding machine 110. The present invention is however not necessarily limited to such a scanning technique. The scanning of the laser light can alternatively be performed by allowing swinging movement of the electrode base 31 while immovably holding the welding machine 110 in position.

The welding is performed by laser irradiation such that the focal point 114 of the laser light is substantially coincident with the bottom surface 95 of the tip 34 in the above first embodiment. The present invention is however not necessarily limited to such focal point setting. The focal point 114 of the laser light can be set as appropriate depending on the shape of the bottom surface of the tip and the like.

Each of the above respective embodiments may be modified by adding thereto one or more of the features of the other embodiments or by replacing one or more of the features of the embodiment with those of the other embodiments. For example, although the bottom surface 95 of the tip 34 is embedded in the electrode base 31 in the above first embodiment, the bottom surface 95 of the tip 34 may be in flush with the facing surface 80 of the electrode base 31 as in the above second embodiment. Although the bottom surface 125 of the tip 121 is flush with the facing surface 80 of the electrode base 31 in the above second embodiment, the bottom surface 125 of the tip 121 may be embedded in the electrode base 31 as in the above first embodiment.

DESCRIPTION OF REFERENCE NUMERALS

10: Spark plug
20: Metal shell
30, 120, 130, 140, 150: Ground electrode
31: Electrode base
32: First end portion
33: Second end portion
34, 121, 131, 141, 151: Tip
50: Center electrode
80: Facing surface
81: Base long side
82: Base short side
83: Opposite surface
84: End surface
85: Side
86: Side surface
90, 122, 132, 142, 152: Top surface
91: Long side
92: Short side
93, 96, 123, 126, 133, 135, 143, 145, 153, 155: Center
95, 125, 134, 144, 154: Bottom surface
100: Weld zone
101: Joint region
102: Interface
103: Back region
104: Core
113: Beam axis
114: Focal point
W1, W2, W3, W4: Width Having described the invention, the following is claimed:

1. A spark plug comprising:

a center electrode;

a metal shell that holds therein the center electrode insulatedly; and a ground electrode that includes an electrode base having a facing surface facing the center electrode and a tip containing a noble metal and arranged on the facing surface of the electrode base, the electrode base being joined at a first end portion thereof to the metal shell, wherein the electrode base has: an opposite surface located opposite the facing surface; an end surface connecting the opposite surface and the facing surface at a second end portion of the electrode base opposite the first end portion; and a pair of side surfaces continuing to the end surface via sides of the second end portion and connecting the facing surface and the opposite surface, wherein the tip has: a top surface facing the center electrode; and a bottom surface located opposite the top surface and joined to the electrode base with a weld zone formed therebetween, wherein the weld zone has: a back region exposed at the opposite surface of the electrode base; a joint region at which the tip is joined; and a connection region connecting the joint region and the back region in a thickness direction of the electrode base without being exposed at the side surfaces of the electrode base, and wherein, in a cross section of the ground electrode taken through the side surfaces of the electrode base along a plane passing through a center of the top surface and a center of the bottom surface of the tip, a maximum width of the connection region in a direction perpendicular to the thickness direction of the electrode base is larger than a width of the back region, and a value of a width of the top surface of the tip being divided by a width of the facing surface of the electrode base is greater than 0.3.

2. The spark plug according to claim 1, wherein, in the cross section, an interface of the joint region with the tip is convex toward the top surface.

3. The spark plug according to claim 1, wherein, in the cross section, the bottom surface of the tip is located closer to the opposite surface than the facing surface of the electrode base, and the joint region is located closer to the opposite surface than the facing surface of the electrode base without being exposed at the facing surface of the electrode base.

4. The spark plug according to claim 1, wherein the facing surface of the electrode base has base long sides bordering the side surfaces and a base short side bordering the end surface and being shorter than the base long sides, wherein the top surface of the tip has a long side and a short side, and wherein the tip is arranged on the facing surface, with the short side of the tip being along the base long side and the long side of the tip being along the base short side.

5. The spark plug according to claim 1, wherein the weld zone is not exposed at the end surface of the electrode base.

6. A production method of a spark plug, the spark plug comprising:

a center electrode;

a metal shell that holds therein the center electrode insulatedly; and a ground electrode that includes an electrode base having a facing surface facing the center electrode and a tip containing a noble metal and arranged on the facing surface of the electrode base, the electrode base being joined at a first end portion thereof to the metal shell, the production method comprising:

a contact step of bringing a bottom surface of the tip opposite to a top surface thereof into contact with the electrode base, the electrode base having: an opposite surface located opposite the facing surface; an end surface connecting the opposite surface and the facing surface at a second end portion of the electrode base opposite the first end portion; and a pair of side surfaces continuing to the end surface via sides of the second end portion and connecting the facing surface and the opposite surface; and an irradiation step of emitting a laser light toward the tip from the opposite surface while moving an beam axis of the laser light in a reciprocating manner relative to the electrode base in a direction in which the side surfaces of the electrode base are opposed to each other, wherein loci of the beam axis intersect at a position facing the opposite surface of the electrode base.

7. The production method of the spark plug according to claim 6, wherein, in the irradiation step, a focal point of the laser light at positions closer to the side surfaces of the electrode base than a position corresponding a center of the bottom surface of the tip is closer to the opposite surface of the electrode base than that at the position corresponding to the center of the bottom surface of the tip.

* * * * *